US010199767B2

(12) United States Patent
Hopf

(10) Patent No.: US 10,199,767 B2
(45) Date of Patent: Feb. 5, 2019

(54) PLUG-IN CONNECTOR WITH LATCHING ELEMENT

(71) Applicant: ODU GmbH & Co. KG, Mühldorf (DE)

(72) Inventor: Albrecht Hopf, Schnaitsee (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 15/435,319

(22) Filed: Feb. 17, 2017

(65) Prior Publication Data

US 2017/0250503 A1 Aug. 31, 2017

(30) Foreign Application Priority Data

Feb. 26, 2016 (EP) ..... 16157705

(51) Int. Cl.
*H01R 13/627* (2006.01)
*H01R 13/53* (2006.01)
(Continued)

(52) U.S. Cl.
CPC ..... *H01R 13/6271* (2013.01); *H01R 13/53* (2013.01); *H01R 13/6278* (2013.01);
(Continued)

(58) Field of Classification Search
CPC ..... H01R 13/6278; H01R 13/6215; H01R 13/6271
(Continued)

(56) References Cited

U.S. PATENT DOCUMENTS 3,368,182 A * 2/1968 Culver ..... H01R 13/6278 285/316
5,376,016 A 12/1994 Inaba et al.
(Continued)

FOREIGN PATENT DOCUMENTS

CN 102132465 A 7/2011
CN 103430396 A 12/2013
(Continued)

OTHER PUBLICATIONS

Search Report of European Patent Application No. 16157705.1 dated Aug. 12, 2016.
(Continued)

*Primary Examiner* — Tho D Ta

(57) ABSTRACT

A plug-in connector comprises a first connecting part with at least one first contact element and a second connecting part with at least one second contact element. The first connecting part is configured for being connected with and disconnected from the second connecting part. The first connecting part comprises a latching element with a snap-in member, and the second connecting part comprises a retaining sleeve configured for accepting the latching element. The latching pin and the retaining sleeve constitute a mechanical mechanism provided in addition to the at least one first contact element and the at least one second contact element. A mechanical interaction between the latching pin and the retaining sleeve enforces a predetermined motion pattern of the at least one first contact element relative to the at least one second contact element during a process of connecting or disconnecting the first connecting part and the second connecting part.

15 Claims, 6 Drawing Sheets

(51) Int. Cl.

| | |
|---|---|
| ***H01R 13/648*** | (2006.01) |
| ***H01R 24/86*** | (2011.01) |
| *H01R 13/621* | (2006.01) |
| *H01R 13/645* | (2006.01) |
| *H01R 107/00* | (2006.01) |

(52) U.S. Cl.
CPC ..... *H01R 13/6485* (2013.01); *H01R 24/86* (2013.01); *H01R 13/6215* (2013.01); *H01R 13/6456* (2013.01); *H01R 2107/00* (2013.01)

(58) Field of Classification Search
USPC ..... 439/350, 352, 364
See application file for complete search history.

(56) References Cited

U.S. PATENT DOCUMENTS

| | | | | |
|---|---|---|---|---|
| 5,632,642 | A * | 5/1997 | Briski | H01R 13/6215 439/364 |
| 5,813,880 | A * | 9/1998 | Kodama | H01R 13/6215 439/364 |
| 6,231,369 | B1 * | 5/2001 | Miyajima | H01R 13/6215 439/364 |
| 7,753,708 | B2 * | 7/2010 | Yoshida | H01R 13/6271 439/345 |
| 7,803,005 | B1 * | 9/2010 | Speaker, IV | H01R 13/5221 439/278 |
| 8,708,731 | B2 * | 4/2014 | Chatelus | H01R 13/6271 439/350 |
| 2003/0218869 | A1 | 11/2003 | Thurmaier | |
| 2014/0017928 | A1 * | 1/2014 | Shah | H01R 13/6277 439/350 |

FOREIGN PATENT DOCUMENTS

| | | | |
|---|---|---|---|
| CN | 204885653 | U | 12/2015 |
| DE | 24 49 035 | A1 | 4/1975 |
| DE | 3602296 | A1 | 7/1987 |
| DE | 101 49 201 | C1 | 6/2003 |
| DE | 20 2012 003 170 | U1 | 5/2012 |
| DE | 10 2011 050 695 | B3 | 10/2012 |
| FR | 2778502 | A1 | 11/1999 |
| GB | 2335088 | A | 9/1999 |

OTHER PUBLICATIONS

1st Office Action of counterpart Chinese Patent Application No. 201710094299.5 dated Aug. 1, 2018.
Examination Report of counterpart European Patent Application No. 16157705.1 dated Feb. 15, 2018.

* cited by examiner

PLUG-IN CONNECTOR WITH LATCHING ELEMENT

CROSS-REFERENCE TO RELATED APPLICATIONS

This application claims the benefit of European Patent Application No. 16157705.1, filed Feb. 26, 2016, the entire content of which is hereby incorporated by reference.

FIELD OF THE INVENTION

The invention relates to a connecting part configured for being connected with another connecting part. The invention further relates to a plug-in connector comprising a first connecting part and a second connecting part. The invention also relates to a method for connecting a first connecting part with a second connecting part, and to a method for disconnecting a first connecting part from a second connecting part.

BACKGROUND OF THE INVENTION

Plug-in connectors are increasingly used in applications where the plug-in connector's connecting parts are connected and disconnected under electrical load. In this case, electric arcs may form between the contact elements of the first connecting part and the contact elements of the second connecting part. These electric arcs may cause degradation and wear of the contact elements. In certain environments, for example in explosion-proof environments, formation of electric arcs is not acceptable, because electric arcs may for example ignite a gas.

German Patent DE 101 49 201 C1 describes an electrical connection system, in particular for establishing and disrupting an electrical connection between two electric wires, with a first and a second connecting piece that can be separated from one another and by their coupling a first electric contact at the first connecting piece electrically contacts a second electrical contact at the second connecting piece and the electrical connection is established. Furthermore, at least one joining resistance is provided, wherein by applying a sufficiently large joining force, the resistance is overcome and the first and the second connecting piece are connected. The first electrical contact, the second electrical contact and the joining resistance are arranged such that when joining the first and the second connecting piece, the first electrical contact contacts the second electrical contact only after overcoming the resistance.

German Utility Model DE 20 2012 003 170 U1 describes a safety system for high current applications comprising a high current fuse and an electrically insulating housing that encloses the high current fuse, the housing being realised as a plug-in connector for electrical contacting and mechanical connection with a mating connector.

German Patent DE 10 2011 050 695 B3 describes an electrical plug-in connector comprising a plug and a socket with small outer dimensions. For switching capacities of about 10 kW, the plug-in connector is disconnectable under electrical load, whereby a possibly emerging electrical arc is extinguished by the gas of an outgasing material. For extinguishing the electrical arc, the electrical arc is constrained to a small, possibly extensive gap, so that the extinguishing gas can function effectively.

German Patent Application DE 24 49 035 A1 describes a separable female connecting part for use in connecting or disconnecting a high voltage circuit by connecting or disconnecting with a complementary connecting part comprising a male contact element, wherein the female connecting part comprises a housing with a first and a second end and a passage axially extending through the housing and a contact arrangement located in the passage of the housing.

OBJECT OF THE INVENTION

The object of the invention is to provide a plug-in connector with a first connecting part and a second connecting part designed such that the formation of an electric arc is reliably suppressed when connecting and disconnecting the connecting parts.

SUMMARY OF THE INVENTION

According to the invention, a connecting part is provided, the connecting part being configured for being connected with another connecting part. The connecting part comprises at least one contact element configured for establishing at least one electrical connection with the other connecting part and a retaining sleeve configured for accepting a latching pin of the other connecting part, wherein the retaining sleeve comprises a first counter-latching element at an intermediate position and a second counter-latching element at a final position.

The connecting part comprises a retaining sleeve with two counter-latching elements. When connecting the connecting part with another connecting part, the connection is effected in two steps. First, the other connecting part's latching pin engages at the intermediate position. Then, the other connecting part with the latching pin is moved from the intermediate position to the final position. Thus, a well-defined connecting and disconnecting process is accomplished, which is particularly important in case the connecting parts are for example connected and disconnected under electrical load. In this case, the intermediate position may for example prevent the formation of electric arcs.

Further according to the invention, a plug-in connector is provided. The plug-in connector comprises a first connecting part with at least one first contact element and a second connecting part with at least one second contact element, wherein the first connecting part is configured for being connected with and disconnected from the second connecting part. The first connecting part comprises a latching pin, and the second connecting part comprises a retaining sleeve configured for accepting the latching pin, wherein the latching pin and the retaining sleeve constitute a mechanical mechanism provided in addition to the at least one first contact element and the at least one second contact element. A mechanical interaction between the latching pin and the retaining sleeve is configured for enforcing a predetermined motion pattern of the at least one first contact element relative to the at least one second contact element during a process of connecting or disconnecting the first connecting part and the second connecting part.

When connecting the first connecting part with the second connecting part or disconnecting the first connecting part from the second connecting part, the dynamics of the connecting or disconnecting process are controlled by the mechanical interaction between the latching pin and the retaining sleeve. The mechanical interaction between the latching pin and the retaining sleeve is configured for enforcing a predetermined motion pattern between the at least one first contact element and the at least one second contact element during a process of connecting or disconnecting the first connecting part and the second connecting part. The motion pattern determines, at least in part, the temporal evolvement of position, speed and acceleration of the at least one first contact element relative to the at least one second contact element. The latching pin may for example comprise one or more latching elements, with said latching elements being adapted for engaging with corresponding counter-latching elements of the retaining sleeve. The interaction between the latching elements and the corresponding counter-latching elements may for example determine rest positions or time delays along the relative motion path of the latching pin relative to the retaining sleeve. Furthermore, force barriers may be set up at predefined positions along the relative motion path of the latching pin relative to the retaining sleeve, with predefined forces being required for overcoming the respective force barrier. Thus, it is accomplished that the mechanical interaction between the latching pin and the retaining sleeve determines the dynamics of the connecting and disconnecting process. As a consequence, during the connecting process or disconnecting process, the dynamics of establishing and disrupting the one or more electrical connections between the at least one first contact element and the at least one second contact element are controlled by the mechanical interaction between the latching pin and the retaining sleeve. For example, it can be made sure that the one or more electrical connections are quickly established or disrupted, which is particularly important when establishing or disrupting electrical connections under load, in order to prevent formation of electric arcs.

Moreover, according to the invention a method for connecting a first connecting part with a second connecting part is provided. The first connecting part comprises at least one first contact element and a latching pin and the second connecting part comprises at least one second contact element and a retaining sleeve configured for accepting the latching pin. The latching pin and the retaining sleeve constitute a mechanical mechanism provided in addition to the at least one first contact element and the at least one second contact element. The method comprises connecting the first connecting part with the second connecting part, wherein a mechanical interaction between the latching pin and the retaining sleeve enforces a predetermined motion pattern of the at least one first contact element relative to the at least one second contact element during the connecting process.

During the connecting process, the dynamics of the relative movement of the second connecting part relative to the first connecting part are determined by the mechanical interaction between the latching pin and the retaining sleeve. Thus, it is accomplished that the electrical connections between the at least one first contact element and the at least one second contact element are established in accordance with the predetermined motion pattern. Thus, it is possible to predetermine required forces, accelerations and rest positions during the connecting process.

According to the invention, a method for disconnecting a first connecting part from a second connecting part is provided. The first connecting part comprises at least one first contact element and a latching pin and the second connecting part comprises at least one second contact element and a retaining sleeve configured for accepting the latching pin. The latching pin and the retaining sleeve constitute a mechanical mechanism provided in addition to the at least one first contact element and the at least one second contact element. The method comprises disconnecting the first connecting part from the second connecting part, wherein a mechanical interaction between the latching pin and the retaining sleeve enforces a predetermined motion pattern of the at least one first contact element relative to the at least one second contact element during the disconnecting process.

During the disconnecting process, the dynamics of the relative movement of the second connecting part relative to the first connecting part are determined by the mechanical interaction between the latching pin and the retaining sleeve. Thus, the electrical connections between the at least one first contact element and the at least one second contact element are disrupted in accordance with the predetermined motion pattern. Thus, it is possible to predetermine required forces, accelerations and rest positions during the disconnecting process.

Preferred Embodiments of the Invention

Preferred features of the invention which may be applied alone or in combination are discussed below and in the dependent claims.

Preferably, the at least one first contact element comprises at least one of: one or more connector pins and one or more connector sockets configured for accepting corresponding connector pins of the second connecting part. Each of the connecting parts comprises connector pins or connector sockets or both connector pins and connector sockets. When connecting the first connecting part with the second connecting part, the connector pins of the first connecting part are inserted into the corresponding connector sockets of the second connecting part, and the connector sockets of the first connecting part accept the corresponding connector pins of the second connecting part.

Preferably, the at least one second contact element comprises at least one of: one or more connector pins and one or more connector sockets configured for accepting corresponding connector pins of the first connecting part.

Preferably, the predetermined motion pattern determines, at least in part, the temporal evolvement of position, speed and acceleration of the at least one first contact element relative to the at least one second contact element.

Preferably, the predetermined motion pattern comprises at least one of the following: one or more rest positions at predetermined positions of the first connecting part relative to the second connecting part, one or more retardations or time delays at predetermined positions of the first connecting part relative to the second connecting part, one or more force barriers at predetermined positions of the first connecting part relative to the second connecting part, each of said force barriers requiring a predetermined minimum force for overcoming the respective force barrier. For example, the latching pin may comprise a latching element, and the retaining sleeve may comprise one or more corresponding counter-latching elements. The mechanical interaction between the latching elements and the counter-latching elements may for example incur retardations and time delays at predefined positions. Furthermore, when the latching element is engaged with a corresponding counter-latching element, a certain force may for example be required for disengaging the latching element from the counter-latching element. Thus, force barriers can be set up along the relative motion path of the first connecting part relative to the second connecting part.

Preferably, the latching pin and the retaining sleeve constitute a separate mechanical mechanism provided in addition to the at least one first contact element and the at least one second contact element. The latching pin and the retaining sleeve may for example be implemented as a distinct mechanical mechanism that is confined to a certain part of the plug-in connector, separate from the first and the second contact elements.

Preferably, the latching pin and the retaining sleeve are not configured for establishing an electrical connection. The latching pin and the retaining sleeve are designed for interacting mechanically. They do not necessarily fulfil any electric function. Electrical connections are solely established between the at least one first contact element and the at least one second contact element.

Preferably, the latching pin comprises one or more latching elements, wherein the retaining sleeve comprises one or more counter-latching elements, and wherein at least one of the latching elements is configured for engaging with at least one of the counter-latching elements.

Preferably, at least one of the latching elements is realised as a protrusion, and at least one of the counter-latching elements is realised as an edge or a recess, with at least one of the protrusions being configured for engaging with at least one of the edges or recesses.

Preferably, at least one of the latching elements is realised as an edge or a recess, and at least one of the counter-latching elements is realised as a protrusion, with at least one of the protrusions being configured for engaging with at least one of the edges or recesses.

Preferably, the latching pin comprises a latching element, and the retaining sleeve comprises a first counter-latching element at an intermediate position and a second counter-latching element at a final position, and the latching pin's latching element is configured for engaging with the first counter-latching element or with the second counter-latching element. When the first connecting part is connected with the second connecting part, the latching pin of the first connecting part is inserted into the retaining sleeve of the second connecting part, whereby the latching pin's latching element engages with the first counter-latching element at the intermediate position. The first counter-latching element defines an intermediate rest position for the latching pin. For disengaging the latching element from the first counter-latching element and moving the latching pin to the second counter-latching element, a predefined minimum force has to be applied to the connecting parts, in order to overcome the force barrier. Thus, it is made sure that the latching pin is quickly moved from the intermediate position to the final position during the connecting process.

In the opposite direction, when the first connecting part is disconnected from the second connecting part, the latching pin's latching element is initially engaged with the second counter-latching element. For disengaging the latching element from the second counter-latching element and moving the latching pin to the first counter-latching element, a predefined minimum force is required, in order to overcome the force barrier. Thus, it is made sure that the latching pin is quickly moved from the final position to the intermediate position during the disconnecting process. Hence, the mechanical interaction between the latching pin and the retaining sleeve defines a predetermined timing of the connecting and disconnecting process.

Preferably, at the latching pin's intermediate position, the at least one first contact element is electrically disconnected from the at least one second contact element, and at the latching pin's final position, at least one electric connection is established between the at least one first contact element and the at least one second contact element. When connecting the first connecting part and the second connecting part, the latching element first engages with the first counter-latching element. In this intermediate position, there are no electrical connections between the first contact element and the second contact elements yet. For moving the latching pin from the intermediate position to the final position, the latching element has to disengage from the first counter-latching element, which requires a force of predefined strength. In the final position, the at least one electric connection is established between the at least one first contact element and the at least one second contact element. By requiring a force of minimum strength, it is made sure that the electrical connections are quickly established. Also when disconnecting the first connecting part from the second connecting part, a force of predefined strength is required for disengaging the latching element from the second counter-latching element. Thus, the electrical connections are quickly disrupted. Especially when for example connecting or disconnecting the connecting parts under electrical load, it is required to quickly establish and disrupt the electrical connections, in order to suppress the formation of electric arcs.

Preferably, the latching element is implemented as a protrusion, wherein the first counter-latching element is implemented as a first edge or a first recess and the second counter-latching element is implemented as a second edge or a second recess, and wherein the latching pin's protrusion is configured for engaging with the retaining sleeve's first edge or first recess or with the retaining sleeve's second edge or second recess.

Preferably, the first connecting part is a connecting plug, with the at least one first contact element being one or more connector pins.

Preferably, the first connecting part is configured for being plugged into the second connecting part. The process of plugging the first connecting part into the second connecting part may for example comprise inserting the connector pins of the first connecting part into the corresponding connector sockets of the second connecting part.

Preferably, in case the latching element is engaged with the first counter-latching element at the intermediate position and an inwardly directed force of predefined minimum strength is applied to the connecting parts, the latching pin's latching element is configured for disengaging from the first counter-latching element, moving to the final position and engaging with the second counter-latching element. During the connecting process, the latching element is initially engaged with the first counter-latching element at the intermediate position. A certain force is required to overcome the force barrier in order to disengage the latching element from the first counter-latching element. Then, the latching element can be moved to the final position, where it engages with the second counter-latching element.

Preferably, the inwardly directed force of predefined minimum strength gives rise to a predefined minimum acceleration of the first connecting part relative to the second connecting part when moving from the intermediate position to the final position. Thus, it is made sure that the two connecting parts are quickly connected, with the timing of the plug-in operation being controlled by the interaction between the latching pin and the retaining sleeve.

Preferably, the predefined minimum acceleration is chosen to prevent formation of an electric arc between any of the first contact elements and the second contact elements. Thus, wear and degradation of electrical contacts are avoided, and a more reliable operation of the plug-in connector is accomplished.

Preferably, in case the latching element is engaged with the second counter-latching element at the final position and an outwardly directed force of predefined minimum strength is applied to the connecting parts, the latching pin's latching element is configured for disengaging from the second counter-latching element at the final position, moving to the intermediate position and engaging with the first counter-latching element. Initially, the latching pin's latching element is engaged with the second counter-latching element at the final position. Now, a certain force barrier has to be overcome in order to disengage the latching element from the second counter-latching element and move it to the first counter-latching element. From there, the latching pin may be pulled out of the retaining sleeve completely.

Preferably, the outwardly directed force of predefined minimum strength gives rise to a predefined minimum acceleration of the first connecting part relative to the second connecting part when moving from the final position to the intermediate position. Thus, the timing of the unplugging process is controlled by the interaction of the latching pin's latching element with the first and second counter-latching element in the retaining sleeve. By requiring a certain minimum force, it is made sure that the connecting parts are quickly unplugged. Thus, the timing is controlled by the mechanical interaction between the latching pin and the retaining sleeve.

Preferably, the predefined minimum acceleration is chosen to prevent formation of an electric arc between any of the first contact elements and the second contact elements.

Preferably, when the second connecting part is disconnected from the first connecting part, the latching element's engagement at the first counter-latching element incurs a time delay that ensures that electric arcs between the at least one first contact element and the at least one second contact element are extinguished. When the latching element passes the first counter-latching element during the process of disconnecting the first connecting part and the second connecting part, the latching element engages with the first counter-latching element, which leads to a corresponding time delay during the disconnecting operation. This additional time delay incurred by the first counter-latching element is helpful for extinguishing any electric arcs that may have formed between the contact elements. Hence, additional delays may be enforced by the mechanical interaction of the latching pin's latching element with the counter-latching elements in the retaining sleeve.

Preferably, the latching element is implemented as a protrusion at the outer surface of the latching pin. Further preferably, the minimum force required for disengaging the protrusion is determined by at least one of: the shape of the protrusion, the dimension of the protrusion, the tilt angle of the protrusion's edge. The force required for disengaging the protrusion from either the first or the second counter-latching element mainly depends on the shape and the dimensions of the protrusion. By varying these parameters, the force required for disengaging the protrusion can be chosen in accordance with the requirements of the respective application.

Preferably, at least an end portion of the latching pin is implemented as a slotted sleeve, the slotted sleeve providing a resilient support for the latching element. When disengaging the latching element from the first or the second counter-latching element, the slotted sleeve is pressed together. Hence, the properties of the slotted sleeve determine the required minimum force for disengaging the latching element.

Preferably, the first counter-latching element is implemented as a first circumferential recess at the inner surface of the retaining sleeve. Preferably, the second counter-latching element is implemented as a second circumferential recess at the inner surface of the retaining sleeve. Further preferably, the latching pin's protrusion is configured for engaging with the first circumferential recess or with the second circumferential recess at the inner surface of the retaining sleeve.

Preferably, the first connecting part and the second connecting part are configured for being connected and disconnected under electrical load. With plug-in connectors of this type, the power does not have to be switched off when connecting and disconnecting the connecting parts. Therefore, the process of connecting and disconnecting has to be carried out quickly.

Preferably, the plug-in connector is configured for being used in explosion-proof environments. For operation in explosion-proof environments, the suppression of electric arcs is absolutely essential. When disconnecting the connecting parts, the electrical contacts of the connecting parts are exposed to the respective atmosphere. At this point of time, it has to be ensured that the electric arcs are extinguished.

Preferably, the latching pin is located at the centre of the first connecting part's front face. Further preferably, the retaining sleeve is located at the centre of the second connecting part's front face. Thus, a symmetric set-up is obtained, with forces being centrically applied to the latching pin and the retaining sleeve.

Preferably, at the first connecting part's front face, a multitude of connector pins are arranged around the latching pin. Preferably, at the second connecting part's front face, a multitude of connector sockets are arranged around the retaining sleeve.

BRIEF DESCRIPTION OF THE DRAWING

The invention is illustrated in greater detail with the aid of schematic drawings.

It shows schematically.

DETAILED DESCRIPTION OF EMBODIMENTS OF THE INVENTION

Figure 1:
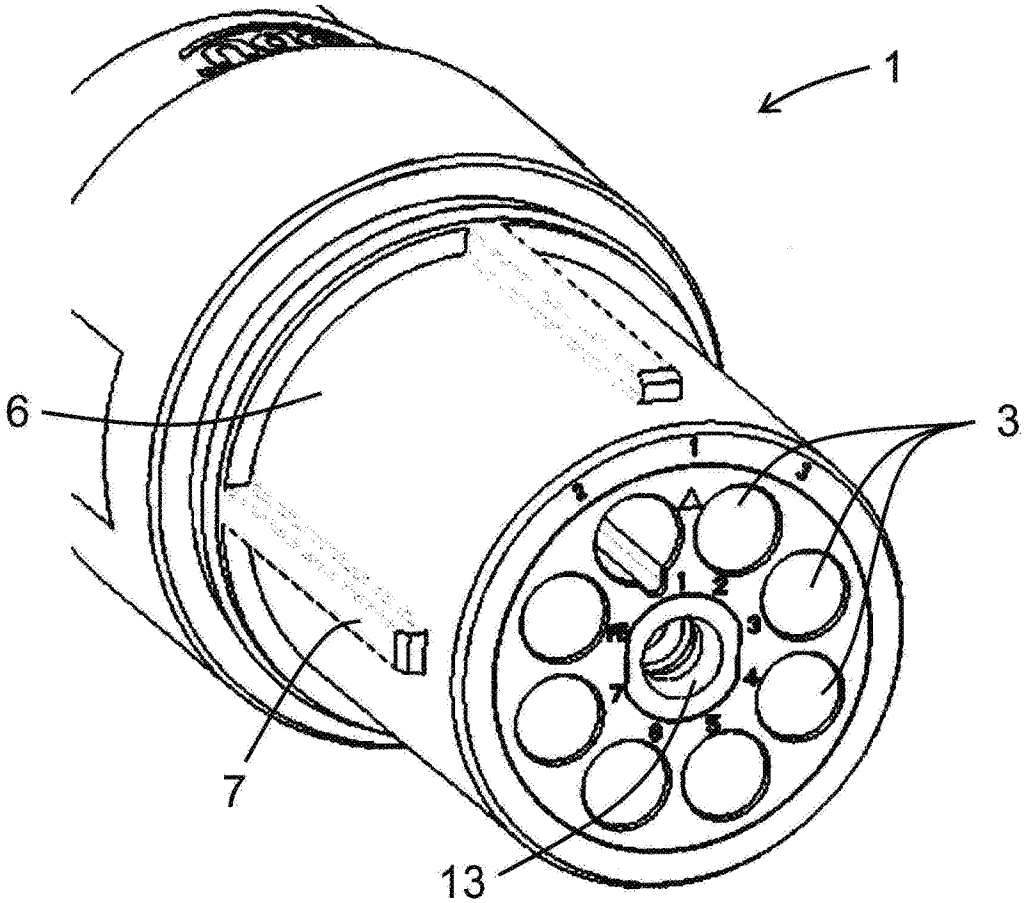
FIG. 1 shows a socket part of a plug-in connector.

In the following description of preferred embodiments of the present invention, identical reference numerals denote identical or comparable components.

Figure 2:
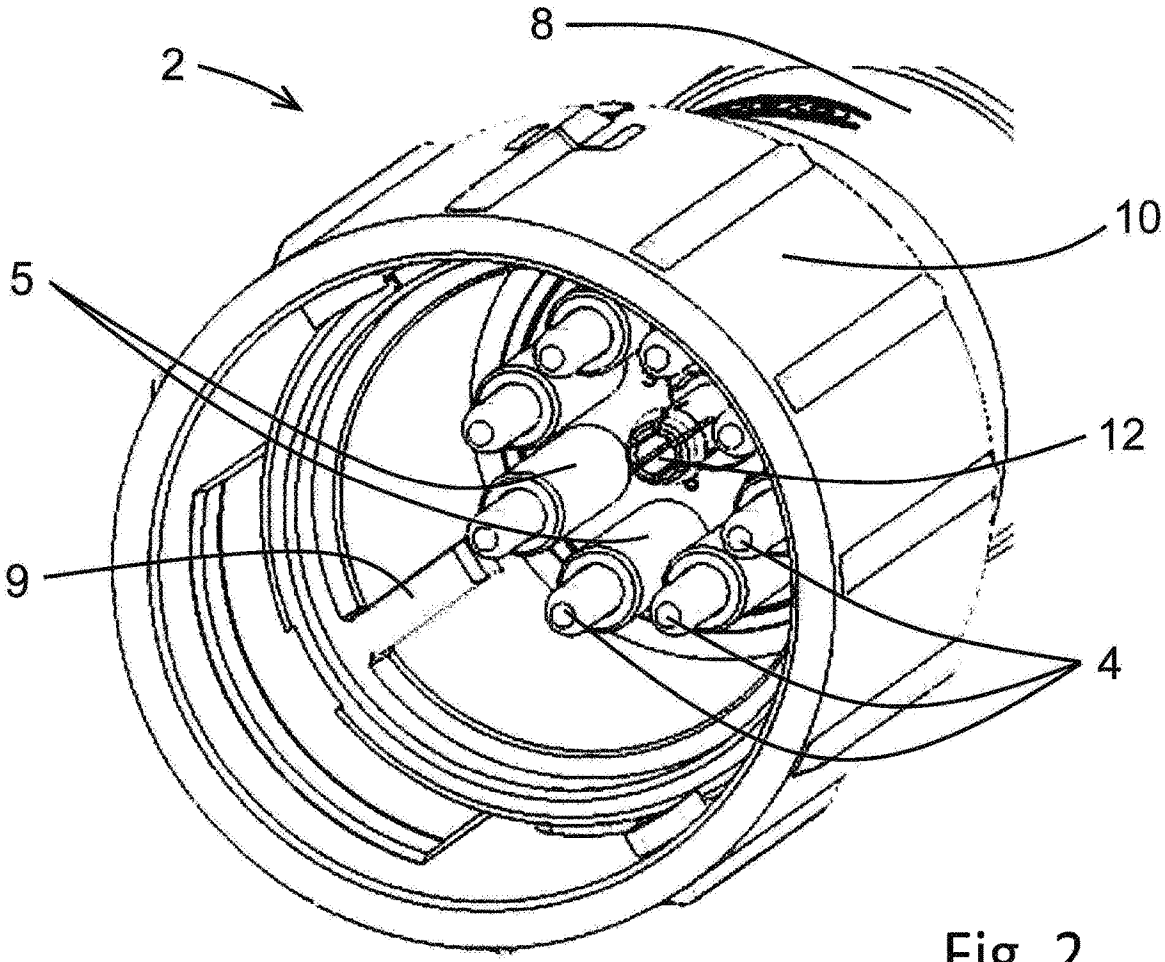
FIG. 2 shows a connector part of a plug-in connector that mates with the socket part shown in FIG. 1.

In FIG. 1, a socket part 1 of a plug-in connector is shown, and in FIG. 2, the corresponding connector part 2 is shown. The socket part 1 comprises a plurality of connector sockets 3 arranged circumferentially around the centre of the socket part 1. Correspondingly, the connector part 2 comprises a plurality of connector pins 4 arranged circumferentially around the centre of the connector part 2, wherein the lower portion of each connector pin 4 is covered by an insulating sleeve 5. When the connector part 2 is plugged onto the socket part 1, each of the connector pins 4 is inserted into a corresponding connector socket 3, thereby establishing an electrical connection between the respective connector pin 4 and the connector socket 3. Hence, when the connector part 2 is plugged onto the socket part 1, a total of eight electrical connections are established between the connector part 2 and the socket part 1.

The housing 6 of the socket part 1 comprises a plurality of ribs 7 extending in the axial direction. Correspondingly, the housing 8 of the connector part 2 comprises a plurality of slits 9. The ribs 7 are configured for engaging with the slits 9, to ensure a desired orientation of the connector part 2 relative to the socket part 1. The connector part 2 further comprises a ring-shaped cover 10 with a bayonet fitting for securing the plug-in connector after the connector part 2 has been plugged onto the socket part 1. The bayonet fitting of the ring-shaped cover 10 is configured for engaging with the corresponding bayonet fitting of the socket part 1, in order to fasten the ring-shaped cover 10 and to protect the plug-in connection.

The socket part 1 shown in FIG. 1 and the connector part 2 shown in FIG. 2 are configured for being connected and disconnected under electrical load. When connecting and disconnecting the connector part 2 and the socket part 1 under electrical load, the problem arises that an electric arc may form between the connector pins 4 and the corresponding connector sockets 3. The formation of electric arcs may lead to erosion and carbonisation of the electric contacts and to partial melting of plastic parts. In explosion protected areas, the formation of light arcs imposes severe safety hazards. Therefore, in plug-in connectors suitable for use in explosion protected areas, the formation of electric arcs is wholly unacceptable.

In order to prevent the formation of electric arcs, the connector part 2 shown in FIG. 2 comprises a latching pin 12 located at the centre of the connector part's front face. Correspondingly, the socket part 1 comprises a retaining sleeve 13 located at the centre of the socket part's front face. When the connector part 2 is plugged onto the socket part 1, the latching pin 12 is inserted into the retaining sleeve 13. The latching pin 12 comprises a latching element that is realised as a snap-in member, the snap-in member being configured for engaging at one of two possible snap-in positions of the retaining sleeve 13.

Figure 3B:
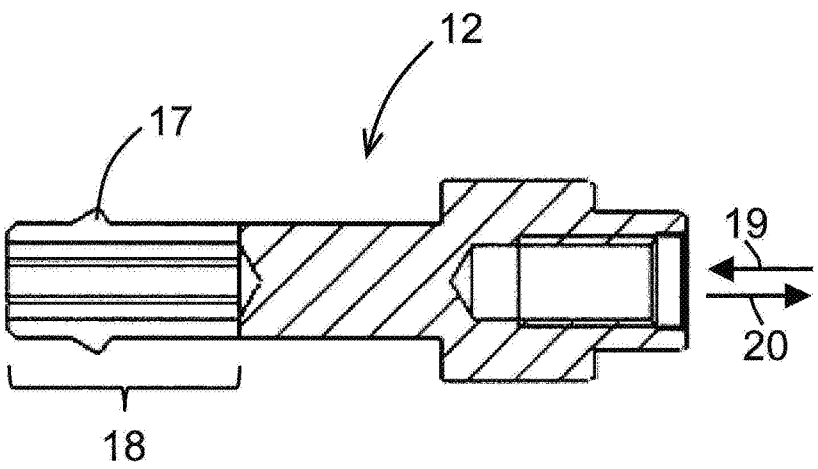
FIG. 3*b* shows a longitudinal section of the latching pin, the latching pin being located at the centre of the connector part's front face.
Figure 3A:
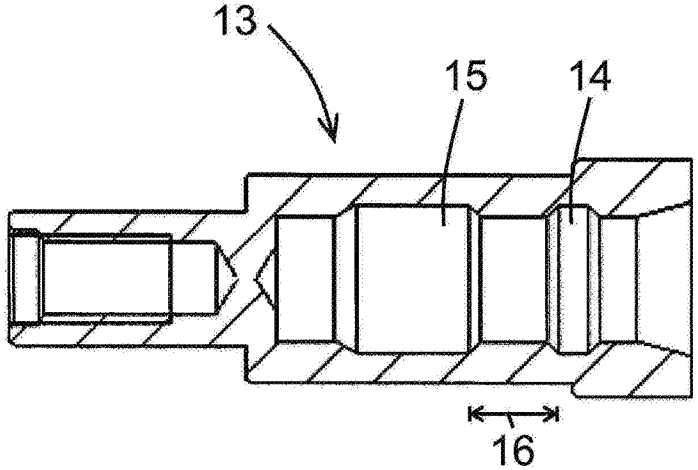
FIG. 3*a* shows a longitudinal section of the retaining sleeve, the retaining sleeve being located at the centre of the socket part's front face.

FIG. 3*a* shows a longitudinal section of the retaining sleeve 13, and FIG. 3*b* shows a longitudinal section of the latching pin 12. In the inner wall of the retaining sleeve 13, a first counter-latching element is located, the first counter-latching element being realised as a first circumferential recess 14 located at an intermediate snap-in position. Further inwards, a second counter-latching element is located, the second counter-latching element being implemented as a second circumferential recess 15 at a final snap-in position. The second circumferential recess 15 is located at a certain distance 16 from the first circumferential recess 14.

FIG. 3*b* shows the corresponding latching pin 12. When the connector part 2 is plugged onto the socket part 1, the latching pin 12 is inserted into the retaining sleeve 13. When the connector part 2 is unplugged, the latching pin 12 is pulled out of the retaining sleeve 13. As shown in FIG. 3*b*, the latching pin 12 comprises a snap-in member 17 that is realised as a protrusion. The front portion 18 of the latching pin 12 is realized as a slotted sleeve, with the slotted sleeve providing a resilient support for the protrusion.

When the connector part 2 is plugged onto the socket part 1, the snap-in member 17 first engages with the first circumferential recess 14. The snap-in member 17 is now located at the intermediate snap-in position of the retaining sleeve 13. For further movement of the latching pin 12 in the inwards direction, an inwardly directed pushing force 19 has to be applied to the latching pin 12. If the inwardly directed pushing force 19 exceeds a predefined force limit, the snap-in member 17 will disengage from the first circumferential recess 14, move in the inwards direction to the second circumferential recess 15 and engage with the second circumferential recess 15. Thus, in case an inwardly directed pushing force 19 of sufficient strength is applied to the latching pin 12, the latching pin 12 will move from the intermediate snap-in position to the final snap-in position of the retaining sleeve 13. Due to the construction of the retaining sleeve 13, the inwardly directed pushing force 19 has to exceed a predefined force limit. The force limit depends for example on the shape and the dimensions of the snap-in member 17 and on the tilt angle of the respective edge of the snap-in member 17.

By requiring an inwardly directed pushing force 19 of a certain strength, it is made sure that the latching pin 12 is moved with a predefined minimum speed from the intermediate snap-in position to the final snap-in position. At the intermediate snap-in position, there is no electric contact between the connector pins 4 and the connector sockets 3 yet. When moving to the final snap-in position, the connector pins 4 get in electric contact with the corresponding connector sockets 3, respectively. By enforcing a minimum speed of this movement, the electrical contacts between the connector pins 3 and the corresponding connector sockets 4 are quickly established, and a formation of electric arcs between the connector pins 4 and the corresponding connector sockets 3 is prevented.

Next, it will be discussed what happens when the connector part 2 is unplugged from the socket part 1. At the beginning, the latching pin 12 is completely inserted in the retaining sleeve 13, with the snap-in member 17 being engaged with the second circumferential recess 15. For retracting the latching pin 12 from the final snap-in position, an outwardly directed pulling force 20 is applied to the latching pin 12. If the outwardly directed pulling force 20 exceeds a predefined force limit, the snap-in member 17 will disengage from the second circumferential recess 15, move from the final snap-in position to the intermediate snap-in position and engage with the first circumferential recess 14. Now, the latching pin 12 is located at the intermediate snap-in position. If the outwardly directed pulling force 20 is persistently applied to the connector part 2, the snap-in member 17 will disengage from the first circumferential recess 14 as well, and the latching pin 12 will be completely pulled out of the retaining sleeve 13.

For moving the latching pin 12 from the final snap-in position to the intermediate snap-in position (and further), the outwardly directed pulling force 20 has to exceed a predefined force limit. The force limit depends for example on the shape and the dimensions of the snap-in member 17 and on the tilt angle of the respective edge of the snap-in member 17. Thus, it is made sure that the outwardly directed pulling force 20 has a certain magnitude, and therefore, the latching pin 12 is moved from the final snap-in position to the intermediate snap-in position with a predefined minimum speed. When moving from the final snap-in position to the intermediate snap-in position, the electric connections between the connector pins 4 and the connector sockets 3 are disrupted, respectively. At the intermediate snap-in position, there is no electric contact between the connector pins 4 and the connector sockets 3 anymore. By enforcing a minimum speed of this movement, the electrical contacts between the connector pins 3 and the connector sockets 4 are quickly disrupted, and electric arcs that may have formed between the connector pins 4 and the corresponding connector sockets 3 are extinguished.

When pulling out the latching pin 12 from the retaining sleeve 13, the snap-in member 17 engages with the first circumferential recess 14 at least for a certain time interval, which causes a time delay at the intermediate snap-in position. During this time delay, any electric arc between a connector pin 4 and a corresponding connector socket 3 is reliably extinguished. The time delay at the intermediate snap-in position is large enough for terminating and extinguishing any electric arcs. Hence, when the snap-in member 17 is pulled out of the first circumferential recess 14, there do not exist any electric arcs anymore. The predefined time delay at the intermediate snap-in position is an important security feature, especially for applications in explosion-proof environments.

Figure 4B:
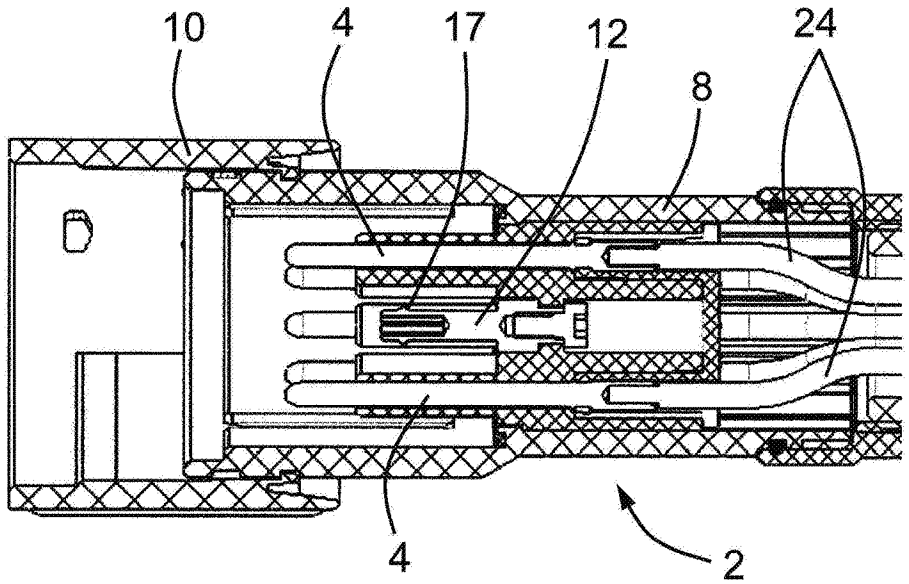
FIG. 4*b* shows a longitudinal section of the connector part.
Figure 4A:
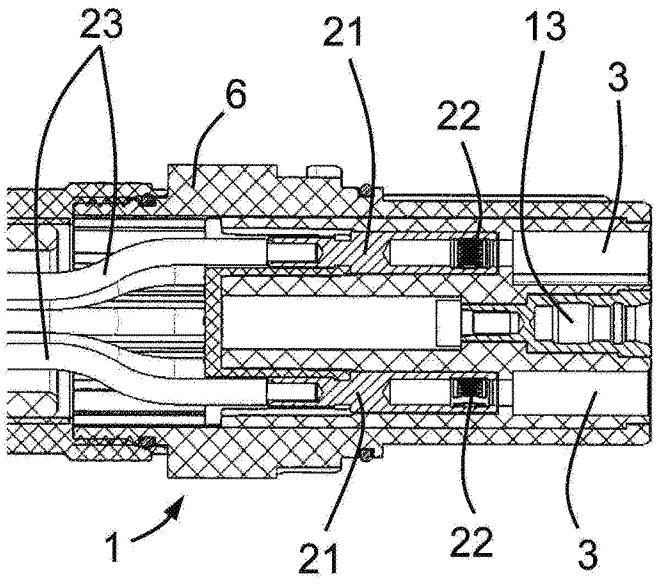
FIG. 4*a* shows a longitudinal section of the socket part.

FIG. 4*a* shows a longitudinal section of the socket part 1. In this longitudinal section, two connector sockets 3 are depicted, with each connector socket 3 comprising a contact sleeve 21 with a lamella socket 22. The lamella socket 22 comprises a plurality of lamellae resiliently bent inwards that are pressed from all sides against a plugged-in connector pin 4 and thus establish an electrical contact between connector pin 4 and connector socket 3. Alternatively, a connector socket with wire spring contacts or a slotted sleeve may be utilised. The socket part 1 further comprises connecting wires 23 for electrically connecting the contact sleeves 21. The connector sockets 3 are arranged around the retaining sleeve 13, which is located at the centre of the socket part's front face. The socket part 1 is contained in a housing 6.

FIG. 4*b* shows a longitudinal section of the corresponding connector part 2. The connector part 2 comprises a plurality of connector pins 4, wherein each connector pin 4 is adapted for being inserted into a corresponding connector socket 3 of the socket part 1. The lower portion of each connector pin 4 is covered by an insulating sleeve 5. The connector part 2 further comprises a plurality of connecting wires 24 for electrically connecting the connector pins 4. The connector pins 4 are circumferentially arranged around the latching pin 12, with the latching pin 12 being located at the connector part's centre. The latching pin 12 is configured for being inserted into the retaining sleeve 13 of the socket part 1, whereby the latching pin's snap-in member 17 may engage either with the first circumferential recess 14 or with the second circumferential recess 15. The connector part 2 is encompassed by a housing 8 and comprises a ring-shaped cover 10, wherein the ring-shaped cover 10 may be fastened at the socket part's housing 6.

Figure 5:
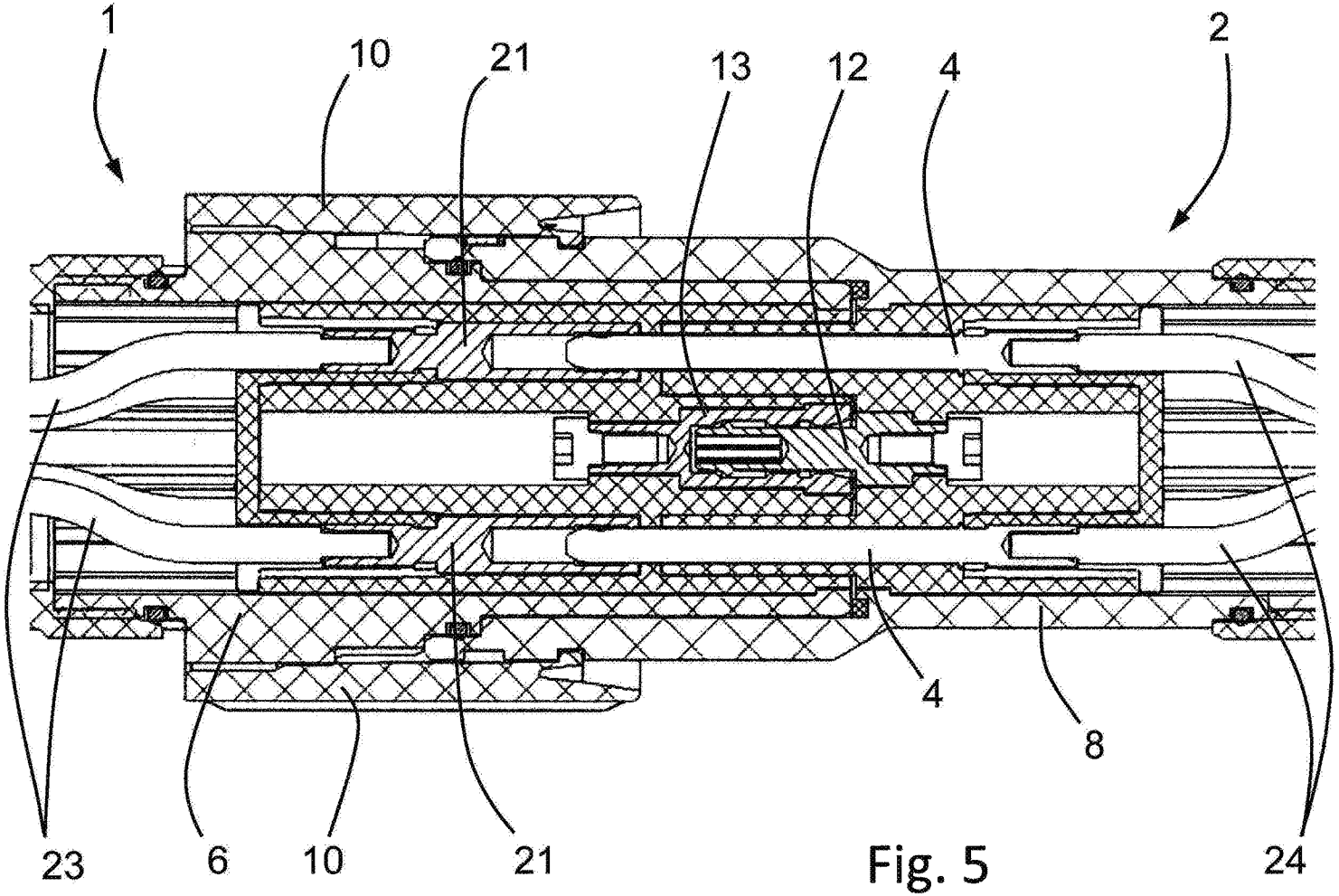
FIG. 5 shows both the socket part and the connector part in the plugged-in state.

FIG. 5 shows a longitudinal section of the socket part 1 and the connector part 2, with the connector part 2 being completely plugged into the socket part 1. Each of the connector pins 4 is inserted into the corresponding connector socket 3, and due to the presence of the lamella sockets 22, a reliable electrical contact is established. The latching pin 12 is completely inserted into the retaining sleeve 13, with the latching pin's snap-in member being engaged with the second circumferential recess 15. The housing 8 of the connector part 2 overlaps with the housing 6 of the socket part 1, and the ring-shaped cover 10 is fastened at the corresponding counterpart at the housing 6.

It can be seen from FIG. 5 that the latching pin 12 and the retaining sleeve 13 together form a mechanical module that is configured for controlling the dynamics of plugging in and unplugging the connecting parts of the plug-in connector. However, electrical connections are solely established between the connector pins 4 and the corresponding connector sockets 3. In the example of FIG. 5, the latching pin 12 and the retaining sleeve 13 do not fulfil any electrical function. The latching pin 12 and the retaining sleeve 13 are solely responsible for controlling the dynamic aspects and the timing when plugging the connector part 2 into the socket part 1 and when unplugging the connector part 2 from the socket part 1.

Figure 6B:
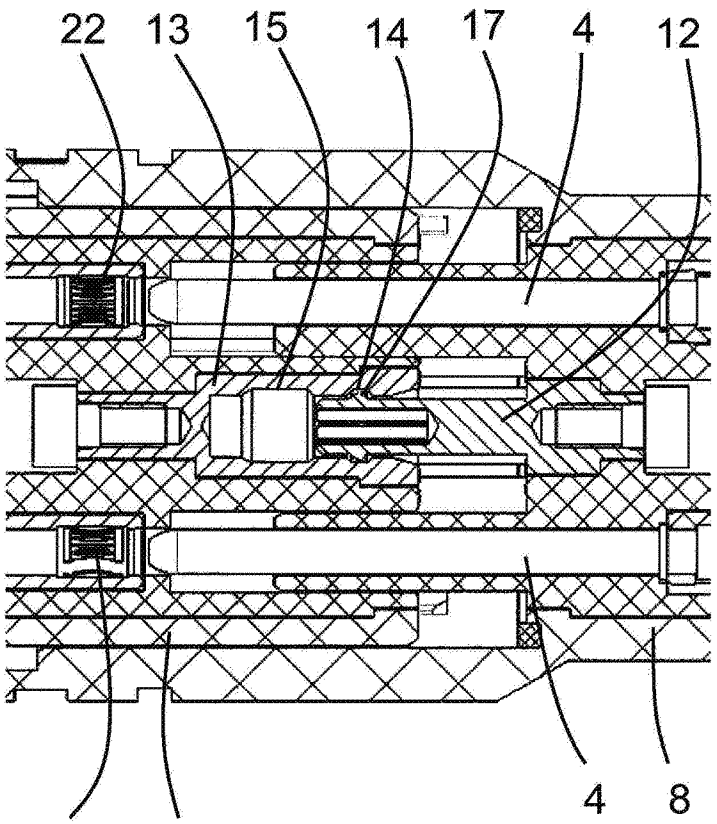
FIG. 6*b* shows the connector part at the intermediate position, wherein the electrical contacts between the connector pins and the corresponding connector sockets are disconnected.
Figure 6A:
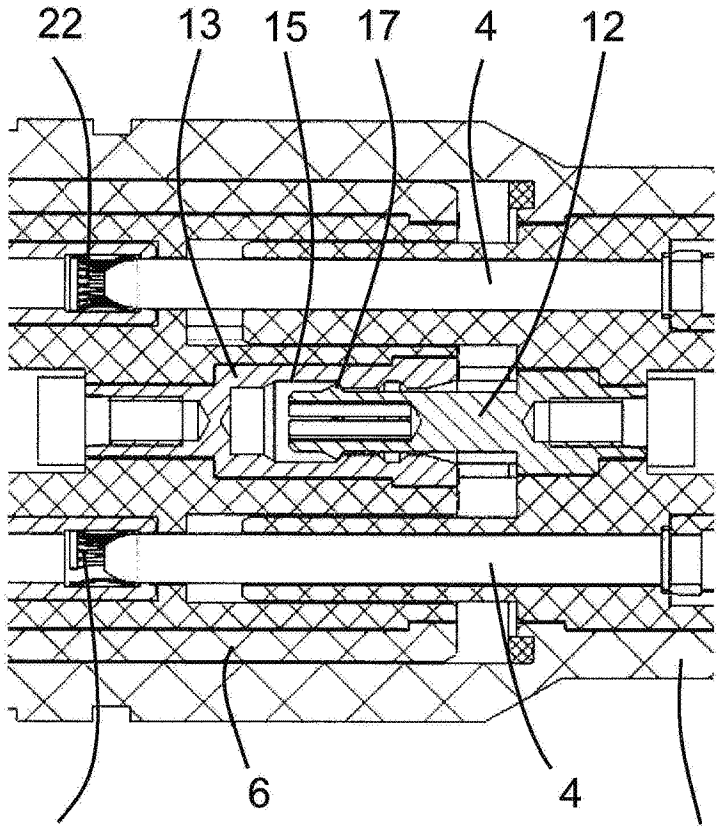
FIG. 6*a* shows how the connector part is plugged with the socket part.

In FIG. 6*a* and FIG. 6*b*, it is shown how the connector part 2 is unplugged from the socket part 1. In FIG. 6*a*, the connector part 2 has been pulled out, whereby the snap-in member 17 of the latching pin 12 is in contact with the utmost right edge of the retaining sleeve's second circumferential recess 15. In this position of the connector part 2, the electrical connections between the connector pins 4 and the corresponding connector sockets 3 are not disrupted yet. For the further outward movement of the connector part 2, a certain pull-out resistance has to be overcome, because the latching pin's snap-in member 17 has to disengage from the second circumferential recess 15 and move to the first circumferential recess 14, whereby the resiliently mounted snap-in member 17 is pressed together. Hence, for pulling the connector part 2 from the final snap-in position to the intermediate snap-in position, an outwardly directed pulling force 20 of a certain strength is required. Thus, it is ensured that the connector part 2 moves from the final snap-in position to the intermediate snap-in position with a predefined speed, thereby preventing the formation of electric arcs.

In FIG. 6*b*, the connector part 2 has arrived at the intermediate snap-in position, whereby the latching pin's snap-in member 17 is engaged with the first circumferential recess 14 of the retaining sleeve 13. In this intermediate snap-in position, there is no electrical contact between the connector pins 4 and the corresponding connector sockets 3 anymore. In general, the quick movement of the connector part 2 does not allow for a formation of electric arcs. But even if there is any electric arc between a connector socket 3 and a corresponding connector pin 4, this electric arc will extinguish during the time interval when the snap-in member 17 is engaged with the first circumferential recess 14. The first circumferential recess 14 enforces a certain time delay before the connector part 2 is pulled out completely. This time delay is an important security feature, because it helps preventing electric arcs, which is particularly important in the field of explosion protection. From the intermediate snap-in position, the connector part 2 may then be pulled out of the socket part 1.

The features described in the above description, claims and figures can be relevant to the invention in any combination. Their reference numerals in the claims have merely been introduced to facilitate reading of the claims. They are by no means meant to be limiting.

LIST OF REFERENCE NUMERALS

1 socket part
2 connector part
3 connector socket
4 connector pin

5 insulating sleeve
6 housing
7 ribs
8 housing
9 slits
10 ring-shaped cover
12 latching pin
13 retaining sleeve
14 first circumferential recess
15 second circumferential recess
16 distance between recesses
17 snap-in member
18 front portion
19 inwardly directed pushing force
20 outwardly directed pulling force
21 contact sleeve
22 lamella socket
23 connecting wires
24 connecting wires

The invention claimed is:

1. A plug-in connector comprising a first connecting part (2) comprising at least one first contact element (4) and a second connecting part (1) comprising at least one second contact element (3), wherein the first connecting part (2) is configured for being connected with and disconnected from the second connecting part (1), wherein the first connecting part (2) comprises a latching pin (12) and the second connecting part (1) comprises a retaining sleeve (13) configured for accepting the latching pin (12), wherein the at least one second contact element (3) is arranged around the retaining sleeve (13), wherein the latching pin (12) and the retaining sleeve (13) constitute a mechanical mechanism provided in addition to the at least one first contact element (4) and the at least one second contact element (3) and wherein a mechanical interaction between the latching pin (12) and the retaining sleeve (13) is configured for enforcing a predetermined motion pattern of the at least one first contact element (4) relative to the at least one second contact element (3) during a process of connecting or disconnecting the first connecting part (2) and the second connecting part (1), wherein at an intermediate position of the latching pin (12) relative to the retaining sleeve (13), the at least one first contact element (4) is electrically disconnected from the at least one second contact element (3), and wherein at a final position of the latching pin (12) relative to the retaining sleeve (13), at least one electric connection is established between the at least one first contact element (4) and the at least one second contact element (3), wherein the plug-in connector is configured such that an outwardly directed pulling force of a certain strength is required for pulling the first connecting part (2) from the final position to the intermediate position of the latching pin (12) relative to the retaining sleeve (13).

2. Plug-in connector according to claim 1, wherein the latching pin (12) and the retaining sleeve (13) are not configured for establishing an electrical connection.

3. Plug-in connector according to claim 1, wherein the latching pin (12) comprises one or more latching elements (17), wherein the retaining sleeve (13) comprises one or more counter-latching elements (14, 15) and wherein at least one of the latching elements (17) is configured for engaging with at least one of the counter-latching elements (14, 15).

4. Plug-in connector according to claim 1, wherein the first connecting part (2) and the second connecting part (1) are configured for being connected and disconnected under electrical load.

5. Plug-in connector according to claim 1, wherein the plug-in connector is configured for being used in explosion-proof environments.

6. Plug-in connector according to claim 1, wherein the latching pin (12) comprises a latching element (17) and wherein the retaining sleeve (13) comprises a first counter-latching element (14) at an intermediate position and a second counter-latching element (15) at a final position, and wherein the latching pin's latching element (17) is configured for engaging with the first counter-latching element (14) or with the second counter-latching element (15).

7. Plug-in connector according to claim 6, wherein at the latching pin's intermediate position the at least one first contact element (4) is electrically disconnected from the at least one second contact element (3), and at the latching pin's final position at least one electric connection is established between the at least one first contact element (4) and the at least one second contact element (3).

8. Plug-in connector according to claim 6, wherein when the second connecting part (1) is disconnected from the first connecting part (2), the latching element's engagement at the first counter-latching element (14) incurs a time delay that ensures that electric arcs between the at least one first contact element (4) and the at least one second contact element (3) are extinguished.

9. Plug-in connector according to claim 6, wherein in case the latching element (17) is engaged with the first counter-latching element (14) at the intermediate position and an inwardly directed force (19) of predefined minimum strength is applied to the connecting parts (1, 2), the latching pin's latching element (17) is configured for disengaging from the first counter-latching element (14), moving to the final position and engaging with the second counter-latching element (15).

10. Plug-in connector according to claim 9, wherein the inwardly directed force (19) of predefined minimum strength gives rise to a predefined minimum acceleration of the first connecting part (2) relative to the second connecting part (1) when moving from the intermediate position to the final position.

11. Plug-in connector according to claim 6, wherein in case the latching element (17) is engaged with the second counter-latching element (15) at the final position and an outwardly directed force (20) of predefined minimum strength is applied to the connecting parts (1, 2), the latching pin's latching element (17) is configured for disengaging from the second counter-latching element (15) at the final position, moving to the intermediate position and engaging with the first counter-latching element (14).

12. Plug-in connector according to claim 11, wherein the outwardly directed force (20) of predefined minimum strength gives rise to a predefined minimum acceleration of the first connecting part (2) relative to the second connecting part (1) when moving from the final position to the intermediate position.

13. A method for connecting a first connecting part (2) with a second connecting part (1), the first connecting part (2) comprising at least one first contact element (4), a latching pin (12) and the second connecting part (1) comprising at least one second contact element (3) and a retaining sleeve (13) configured for accepting the latching pin (12), wherein the at least one second contact element (3) is arranged around the retaining sleeve (13), wherein the latching pin (12) and the retaining sleeve (13) constitute a mechanical mechanism provided in addition to the at least one first contact element (4) and the at least one second contact element (3), the method comprising connecting the first connecting part (2) with the second connecting part (1), wherein a mechanical interaction between the latching pin (12) and the retaining sleeve (13) enforces a predetermined motion pattern of the at least one first contact element (4) relative to the at least one second contact element (3) during the connecting process, wherein at an intermediate position of the latching pin (12) relative to the retaining sleeve (13), the at least one first contact element (4) is electrically disconnected from the at least one second contact element (3), and wherein at a final position of the latching pin (12) relative to the retaining sleeve (13), at least one electric connection is established between the at least one first contact element (4) and the at least one second contact element (3), wherein in case an inwardly directed pushing force of sufficient strength is applied to the latching pin (12), the latching pin (12) will move from the intermediate position to the final position.

14. A method for disconnecting a first connecting part (2) from a second connecting part (1), the first connecting part (2) comprising at least one first contact element (4), a latching pin (12) and the second connecting part (1) comprising at least one second contact element (3) and a retaining sleeve (13) for accepting the latching pin (12), wherein the at least one second contact element (3) is arranged around the retaining sleeve (13), wherein the latching pin (12) and the retaining sleeve (13) constitute a mechanical mechanism provided in addition to the at least one first contact element (4) and the at least one second contact element (3), the method comprising disconnecting the first connecting part (2) from the second connecting part (1), wherein a mechanical interaction between the latching pin (12) and the retaining sleeve (13) enforces a predetermined motion pattern of the at least one first contact element (4) relative to the at least one second contact element (3) during the disconnecting process, wherein at an intermediate position of the latching pin (12) relative to the retaining sleeve (13), the at least one first contact element (4) is electrically disconnected from the at least one second contact element (3), and wherein at a final position of the latching pin (12) relative to the retaining sleeve (13), at least one electric connection is established between the at least one first contact element (4) and the at least one second contact element (3), wherein an outwardly directed pulling force of a certain strength is required for pulling the first connecting part (2) from the final position to the intermediate position.

15. A plug-in connector comprising a first connecting part (2) comprising at least one first contact element (4) and a second connecting part (1) comprising at least one second contact element (3), wherein the first connecting part (2) is configured for being connected with and disconnected from the second connecting part (1), wherein the first connecting part (2) comprises a latching pin (12) and the second connecting part (1) comprises a retaining sleeve (13) configured for accepting the latching pin (12), wherein the at least one second contact element (3) is arranged around the retaining sleeve (13), wherein the latching pin (12) and the retaining sleeve (13) constitute a mechanical mechanism provided in addition to the at least one first contact element (4) and the at least one second contact element (3) and wherein a mechanical interaction between the latching pin (12) and the retaining sleeve (13) is configured for enforcing a predetermined motion pattern of the at least one first contact element (4) relative to the at least one second contact element (3) during a process of connecting or disconnecting the first connecting part (2) and the second connecting part (1), wherein at an intermediate position of the latching pin (12) relative to the retaining sleeve (13), the at least one first contact element (4) is electrically disconnected from the at least one second contact element (3), and wherein at a final position of the latching pin (12) relative to the retaining sleeve (13), at least one electric connection is established between the at least one first contact element (4) and the at least one second contact element (3), wherein the plug-in connector is configured such that in case an inwardly directed pushing force of sufficient strength is applied to the latching pin (12), the latching pin (12) will move from the intermediate position to the final position.

* * * * *